US009726193B2

(12) United States Patent
Koning et al.

(10) Patent No.: US 9,726,193 B2
(45) Date of Patent: Aug. 8, 2017

(54) PUMP AND A METHOD OF MANUFACTURING SUCH A PUMP

(71) Applicant: IHC HOLLAND IE B.V., Sliedrecht (NL)

(72) Inventors: Theodorus Adrianus Koning, Breda (NL); Niels Dentro, Rotterdam (NL)

(73) Assignee: IHC Holland IE B.V., Sliedrecht (NL)

( * ) Notice: Subject to any disclaimer, the term of this patent is extended or adjusted under 35 U.S.C. 154(b) by 363 days.

(21) Appl. No.: 14/374,597

(22) PCT Filed: Jan. 23, 2013

(86) PCT No.: PCT/NL2013/050030

§ 371 (c)(1),
(2) Date: Jul. 25, 2014

(87) PCT Pub. No.: WO2013/112045

PCT Pub. Date: Aug. 1, 2013

(65) Prior Publication Data

US 2014/0348645 A1 Nov. 27, 2014

(30) Foreign Application Priority Data

Jan. 25, 2012 (NL) ..... 2008180

(51) Int. Cl.
*F04D 29/40* (2006.01)
*F04D 7/04* (2006.01)
(Continued)

(52) U.S. Cl.
CPC ..... *F04D 29/403* (2013.01); *B22D 25/02* (2013.01); *F04D 7/04* (2013.01); *F04D 29/628* (2013.01);
(Continued)

(58) Field of Classification Search
CPC ..... F04D 29/026; F04D 29/40; F04D 29/403; F04D 29/406; F04D 29/628; F04D 29/00;
(Continued)

(56) References Cited

U.S. PATENT DOCUMENTS 2,537,084 A * 1/1951 Pfarrer ..... F04D 29/2294 415/197
2,856,858 A * 10/1958 Purcell ..... F04D 29/4286 406/99
(Continued)

FOREIGN PATENT DOCUMENTS

CN 201 661 518 12/2010
DE 1112897 8/1961
(Continued)

OTHER PUBLICATIONS

International Search Report dated Mar. 19, 2013, corresponding to PCT/NL2013/050030.

*Primary Examiner* — Eric Keasel
*Assistant Examiner* — Joshua R Beebe
(74) *Attorney, Agent, or Firm* — NLO N.V.; Catherine A. Shultz; Minerva Rivero

(57) ABSTRACT

The pump housing (2) includes a circumferential wall (3), a pump casing (20) and a shaft cover (40). The pump casing (20) is attached to the circumferential wall (3) by a plurality of connection elements. The pump casing (20) includes a central opening (27) to form an axial supply (14) of the pump housing (2) for material to be pumped. The circumferential wall (3) closes the pump housing (2) along its outer circumference. The pump (1) includes a plurality of connection elements (22) connecting the pump casing (20) to the circumferential wall (3). The connection elements (22) are positioned in groups along the circumference of the
(Continued)

pump housing (2), wherein the groups are regularly distributed along the circumference of the pump housing (2).

5 Claims, 6 Drawing Sheets

(51) Int. Cl.
*F04D 29/62* (2006.01)
*B22D 25/02* (2006.01)

(52) U.S. Cl.
CPC ..... *F05B 2230/21* (2013.01); *F05D 2240/00* (2013.01)

(58) Field of Classification Search
CPC .... F04D 7/04; F05D 2230/21; F05D 2240/14; F05D 2260/111; F05D 2260/31; F05D 2240/00; B22D 25/02
USPC ..... 164/359, 360, 133
See application file for complete search history.

(56) References Cited

U.S. PATENT DOCUMENTS 2,976,809 A 3/1961 Buschhorn et al.
3,018,736 A 1/1962 Clay
3,265,002 A 8/1966 Warman
3,333,872 A * 8/1967 Crawford, Sr. ..... F16L 21/08 285/374
3,465,681 A * 9/1969 Zimmermann ..... F04D 13/025 310/104
3,473,573 A * 10/1969 Baker ..... E21B 33/00 138/89
4,113,407 A * 9/1978 Grzina ..... F04D 7/04 285/350
4,247,074 A * 1/1981 Stratmann ..... B23K 23/00 164/333
4,264,273 A * 4/1981 Grzina ..... F04D 29/4286 415/197
6,267,268 B1 * 7/2001 Quartarone ..... B67D 1/10 222/129.1
7,470,106 B1 * 12/2008 Blattmann ..... F04D 7/045 415/196

FOREIGN PATENT DOCUMENTS

| | | |
|---|---|---|
| DE | 2541422 | 3/1977 |
| DE | 20 2007 018 626 | 4/2009 |
| EP | 1 413 761 | 4/2004 |
| EP | 1903216 | 3/2008 |
| EP | 1906029 | 4/2008 |
| FR | 567370 | 2/1924 |
| GB | 719285 | 12/1954 |
| GB | 867 802 | 5/1961 |
| GB | 1 517 400 | 7/1978 |
| GB | 2 391 266 | 2/2004 |
| NL | 111055 | 10/1933 |
| WO | 2009/149511 | 12/2009 |
| WO | 2011/023873 | 3/2011 |

* cited by examiner

PUMP AND A METHOD OF MANUFACTURING SUCH A PUMP

TECHNICAL FIELD

The invention relates to a pump, a pump housing and a method of manufacturing such as a pump and pump housing.

BACKGROUND

Centrifugal pumps are known, for instance from European patent applications EP1903216 and EP1906029. Such pumps can be used for dredging purposes, i.e. to pump slurry comprising water and dredged materials. An example of such a centrifugal pump is depicted in FIGS. 1 and 2.

FIGS. 1 and 2 schematically depict an example of such a known centrifugal pump 1, both Figures showing a cross-sectional view in different directions. The pump 1 comprises a pump housing 2 shaped like a volute (spiral casing). The pump housing 2 comprises a circumferential wall 3, a pump casing 20 and a shaft cover 40. The circumferential wall 3 comprises a spout-shaped outlet 5 attached tangentially to the circumferential wall 3. The junction between the inner surface of the tangential outlet 5 and the inner surface of the circumferential wall 3 of the pump housing 2 defines what is known as a cutwater 4. The pump housing 2 also has an axial inlet 6, shown in FIG. 2.

The circumferential wall 3 may have a U-shaped or semicircular cross-section, comprising two (parallel) legs 31 extending in a radial inward direction and a middle part connecting the two legs forming the outer wall 32 of the circumferential wall. This outer wall 32 may be a straight part or may be curved.

The outer wall 32 spirals outwardly about the axial rotation axis A of the pump 1 (defined below) towards the tangential outlet 5.

A rotor 7 is attached in the pump housing 2 such that it may rotate about an axial rotation axis A. The rotor 7 comprises rotor blades 15, a shaft shield 11 and a suction shield 12. The rotor 7 also comprises a central boss 9 which may be fastened to a drive shaft (51). The shaft shield 11 extends from the central boss 9. The shaft shield 11 forms a first wall for delimiting the flow within the rotor 7. Axially set apart from the shaft shield 11, the rotor 7 has the suction shield 12 which defines a second wall for delimiting the flow within the rotor 7. The suction shield 12 has an axial supply 14 which is aligned with the axial inlet of the pump housing 2.

A plurality of rotor blades 15 are fastened between the shields 11, 12. In this illustrative embodiment, the rotor 7 comprises three rotor blades 15. The rotor blades 15 each extend substantially radial to the rotation axis A. Between the radial outer ends 17 of the rotor 7 and the inner surface of the circumferential wall 3 of the pump housing 2 there is a circumferential channel 19.

The circumferential wall 3 of the pump housing 2 substantially closes the inner space of the rotor 7 along its outer circumference between the shields 11, 12 and may have a rounded shape.

In order to provide a strong pump, the pump housing 2 further comprises a pump casing 20 and a shaft cover 40, both attached to the circumferential wall 3.

The pump casing 20 is attached to the pump housing 2, i.e. to the circumferential wall 3, by suitable connection means 22. The pump casing 20 has a central opening which may form the axial supply 14 or may surround the axial supply 14. The pump casing 20 may comprise a stepped part 23 and reinforcing ribs 21 (not shown in FIGS. 1 and 2). The term pump casing in this text is used to refer to a part of the pump housing 2 extending between the central opening to the circumferential wall 3. The pump casing 20 may also be referred to as the suction cover or suction lid 20.

The shaft cover 40 (or shaft lid 40) is also attached to the circumferential wall 3 opposite the pump casing 20, by suitable connection means 42. The shaft cover 40 also has a central opening to allow a drive axis 51 of a pump motor 50 to be connected to the rotor 7.

During operation, the drive axis 51 and the rotor 7 rotate about the rotation axis A. Between the rotor blades 15, the mass to be pumped is forced radially outward into the pump housing 2 under the influence of centrifugal forces. Said mass is then entrained in the circumferential direction of the pump housing 2 toward the tangential outlet spout 5 of the pump housing 2. The pumped mass which, after leaving the rotor 7, is entrained in the circumferential direction of the pump housing 2 flows largely out of the tangential outlet of the pump housing 2. A small amount of the entrained mass re-circulates, i.e. flows along the cutwater 4 back into the pump housing 2.

When such pumps are used for dredging, the pumps may be subjected to extreme wear, especially the rotor 7 and the circumferential wall 3. Therefore preferably wear resistant material is used. However, these materials are in general not well suited for construction purposes, as they are usually brittle. An example of such a material is white cast iron such as maxidur.

As a result of the pumping, high pressure will be generated forcing the pump casing 20 outwardly. High loads may be transferred via connection means 22. From FIG. 2 it can be seen that these loads may introduce a bending moment in the circumferential wall 3 of the pump housing 2, as the leg 31 to which the pump casing 20 is attached is forced in an outward direction. To prevent introducing a bending moment, or keeping the bending moment relatively small, in the circumferential wall 3 of the pump housing 2, it is known to position the connection means 22 more outwardly than shown in FIG. 2, i.e. along the outer circumference of the circumferential wall 3 of the pump housing 2, at the position where the circumferential wall 3 is relatively thick (seen in the direction of the connection means 22) and is thus able to take up high loads. An example of this is the LSA-S Series Slurry Pumps of GIW Industries.

This will result in lower stresses in the circumferential wall 3 of the pump housing 2 and reduces the chance of deformation of the circumferential wall 3.

Further examples of connection means provided along the outer circumference are provided by DE2541422A1, GB719285A and FR567370A.

WO2009149511 shows a pump assembly with a pump housing comprising two casting parts which are joined together about the periphery of the two side casing parts, without the use of a circumferential wall as described above. The two side casing parts comprise apertures to allow the two side casing parts to be joined together by bolts. One of the side casing parts also comprises apertures for receiving liner locating and fixing pins for locating the main liner or volute and the pump outer casing relative to another.

SUMMARY

It is an object to provide a pump housing and pump which is stiffer, stronger and thus more efficient. It is also an object to provide an improved method of manufacturing such a pump housing and pump.

Therefore, according to a first aspect there is provided a pump housing comprising a circumferential wall, a pump casing and a shaft cover, wherein the pump casing is attached to the circumferential wall by a plurality of connection means, and wherein the pump casing comprises a central opening to form an axial supply of the pump housing for material to be pumped, the circumferential wall closing the pump housing along an outer circumference of the pump housing, wherein the pump comprises a plurality of connection means connecting the pump casing to the circumferential wall, wherein the connection means are positioned in groups along the circumference of the pump housing, each group comprising a plurality of connection means, wherein the groups are distributed along the circumference of the pump housing, wherein the connection means are formed by bolts, and bolt receiving holes provided on the circumferential wall and bolt receiving holes provided on the pump casing, wherein the circumferential wall comprises bolt receiving structures provided on the outer circumference of the circumferential wall, wherein the bolt receiving structures protrude in a radially outward direction, and wherein each bolt receiving structure comprises at least two bolt receiving holes.

By providing the connection means in groups, a group comprising two or more connection means, and distributing the groups at regular intervals along the circumference of the pump housing, a strong and stiff pump housing is created, which can also be manufactured in an advantageous way. Such connection means in groups are not present in WO2009149511, The groups may be pairs comprising two connection means, whereby a pair is defined as two connection means with a distance between those two connection means which is at least ½ the distance between each connection means of that pair to the next closest connection means. This ratio may preferably be ⅓ or even ⅕.

A group may also comprise more than two connection means, whereby a group is defined as a plurality of connection means whereby a largest distance between any two connection means of the group is at least ½ the distance between each connection means of that group to the next closest connection means of a different group. This ratio may preferably be ⅓ or even ⅕.

The term regularly distributed is used to indicate that the groups or pairs are distributed along the circumference of the pump housing at substantially constant angles when seen from a centre point of the pump housing, i.e. at angles $\alpha$ equal to 360/n, n being an integer greater than 1, for instance 2, 3, 4, 5, 6, 7, 8, . . . . The term substantially constant is used to indicate that the different angles deviate less than 5%, preferably less than 2% with respect to each other.

The term connection means in this text is used to refer to connection means capable of securing the pump casing to the circumferential wall. The connection means are arranged to withstand forces pushing the pump casing and the circumferential wall away from each other, in particular in a direction perpendicular to the interface of the pump casing and the circumferential wall. Such forces are generated inside the pump housing as a result of increased pressure inside the pump housing when the pump is in operation.

For instance, the connection means may be formed by a screw bolt and corresponding screw bolt receiving holes with an inner screw thread. It is noted that the receiving holes may be provided in the pump casing and the circumferential wall of which only the receiving holes in the circumferential wall are screw bolt receiving holes.

According to an embodiment the pump casing comprises a plurality of reinforcing ribs positioned radially with respect to the central opening, wherein the connection means are positioned adjacent reinforcing ribs.

By providing the connection means adjacent the reinforcing ribs, the pump is stronger and stiffer, which is beneficial to the performance of the pump. The connection means hold the pump casing in position. The connection means are now positioned close to the reinforcing ribs, i.e. at a position where the pump casing is relatively strong. This results in an improved stress distribution, making the pump relatively strong and stiff.

The reinforcing ribs may extend from the axial supply towards the outer circumference of the pump casing. The ribs may have a triangular shape and may be orientated such that the height of the ribs reduces towards the outer circumference of the pump casing. There may be any suitable amount of ribs provided, such as eight, twelve or sixteen ribs. The ribs may be uniformly distributed.

The circumferential wall closes the pump housing along its outer circumference, but it will be understood that the circumferential wall may also comprise an outlet for the pumped materials.

The term adjacent is used to indicate that the distance taken along the perimeter of the pump casing between the connection means and the nearest reinforcing rib is at least 5 times smaller than the distance between the connection means and the second nearest reinforcing rib. Preferably, this distance may be at least 10 times smaller.

According to an embodiment the connection means of a group are positioned on opposite sides of the adjacent reinforcing rib.

The connection means forming a group or pair may be provided on opposite sides of the reinforcing ribs to provide a strong and symmetric construction. The connection means forming a pair may be positioned at the same distance from the associated reinforcing rib at opposite sides of the reinforcing rib.

Each reinforcing rib 21 may be provided with a pair of connection means 22, possibly with an exception for a minority of reinforcing ribs 21, e.g. one or two reinforcing ribs 21, which may be left without connection means 22 to meet certain constructional requirements or the like.

By placing connection means on either side of the reinforcing ribs the construction becomes even stiffer and the even stress distribution results in lower stresses.

Instead of pairs, groups of connection means may be provided, wherein a group comprises two, three, four or more connection means to provide an even stronger pump housing.

It is noted that although the connection means or pairs of connection means may be regularly distributed along the outer circumference, one or two connection means may be omitted, as already indicated above.

Such a distribution provides a relatively strong and stiff pump and simplifies the design and manufacturing process. The circumferential wall of the pump housing may be casted. The connection means, which may be bolt receiving structures provided on the outside of the outer circumference may also function as casting inlets for the casting material (such as liquid steel) during the casting process.

In case the connection means are provided in pairs, an additional advantage is provided. One casting inlet may then be provided for each pair. This allows a relatively large casting inlet, which is beneficial, as the casting material needs to be supplied to the mould sufficiently fast such that it can spread through the mould before it is solidified.

According to an embodiment the connection means are positioned along the outer circumference of the pump and connect the pump casing to a radial outer wall of the circumferential wall.

Providing the connection means along the outer circumference provides an even stronger and stiffer pump as bending moments in the circumferential wall, especially in the radial inwardly protruding legs of the circumferential wall are minimized and the connection means engage the circumferential wall at the outer wall, i.e. at a position where the circumferential wall is relatively thick in the axial direction.

The connection means are formed by a connection member, such as a bolt, and bolt receiving holes provided on the circumferential wall and bolt receiving holes provided on the pump casing.

The connection member may be a screw bolt. One or both of the bolt receiving holes may be a screw bolt receiving hole comprising an inner thread to receive the screw bolt and hold the screw bolt in position. In order to provide a reliable inner thread a soft insert may be used. The material used for the pump housing is typically wear resistant material, i.e. it is hard but brittle, which is thus, mechanically and production wise, not well suited for threaded holes. An example of such a material is steel S235. To overcome this, a soft insert may be applied which is more suitable for providing an inner thread.

The bolt receiving holes provided on the circumferential wall and the bolt receiving holes provided on the pump casing are aligned with respect to each other.

The circumferential wall comprises bolt receiving structures provided on the outer circumference of the circumferential wall.

The bolt receiving structures may protrude in a radial outward direction. The bolt receiving structures may be integrally formed with the circumferential wall. This provides a robust circumferential wall. This embodiment also provides advantages for the manufacturing process, as will be described in more detail below.

Each bolt receiving structure comprises at least two bolt receiving holes.

In order to prevent cracks and the like in the bolt receiving structures, the bolt receiving holes may not be positioned too close to each other, especially when soft inserts are used. As a consequence, the bolt receiving structures may not be too small. Such bolt receiving structures provide advantages in the manufacturing process. Also, such a design minimizes the amount of material that is needed.

According to an aspect there is provided a pump comprising a pump housing according to the above.

According to an aspect there is provided a circumferential wall of a pump housing, the circumferential wall comprises a spiral shaped outer wall and two inwardly protruding legs attached to the outer wall, wherein the circumferential wall comprises bolt receiving holes which are positioned in groups along the circumference of the circumferential wall, wherein the groups are regularly distributed along the circumference of the circumferential wall. The bolt receiving holes may be screw bolt receiving holes provided with an inner thread.

According to an aspect there is provided a method of manufacturing a circumferential wall for a pump housing, and wherein the circumferential wall comprises bolt receiving holes provided on the outside of the circumferential wall, wherein the method comprises:

providing a mould for the circumferential wall, the mould comprising a plurality of casting openings, filling the mould with a liquid casting material by supplying the casting material to the mould via the casting openings, allowing the casting material to solidify in the mould, removing the mould, characterized by the bolt receiving holes are positioned in groups along the circumference of the circumferential wall, wherein the groups are regularly distributed along the circumference of the circumferential wall, wherein the circumferential wall comprises bolt receiving structures provided on the outer circumference of the circumferential wall, wherein the bolt receiving structures protrude in a radially outward direction, wherein each bolt receiving structure comprises at least two bolt receiving holes, which bolt receiving structures coincide with the casting openings and/or function as risers during casting.

The design of the circumferential wall in combination with the positioning of the casting openings provides an advantageous method of manufacturing a circumferential wall. The bolt receiving structures, which may be formed as a structure protruding in a radial outward direction from the spiral shaped outer wall provides an optimal structure for the casting openings of the mould. Also, such bolt receiving structures are suitable to be used as risers, especially since the connecting means are provided in groups making the bolt receiving structures relatively large. Preferably, risers are not too small as this will cause the casting material to solidify too quickly prohibiting the riser to function properly.

Such bolt receiving structures will typically be larger than bolt receiving structures for one bolt receiving hole, making these bolt receiving structures even more suitable to be used as casting inlets, as relative large quantities of casting material may be supplied into the mould via each cast opening, allowing a fast casting process.

According to an embodiment the casting material is one of steel, cast steel, grey or white cast iron.

BRIEF DESCRIPTION OF THE DRAWINGS

Embodiments will now be described, by way of example only, with reference to the accompanying schematic drawings in which corresponding reference symbols indicate corresponding parts, and in which.

The figures are meant for illustrative purposes only, and do not serve as restriction of the scope or the protection as laid down by the claims.

DETAILED DESCRIPTION

Figure 1:
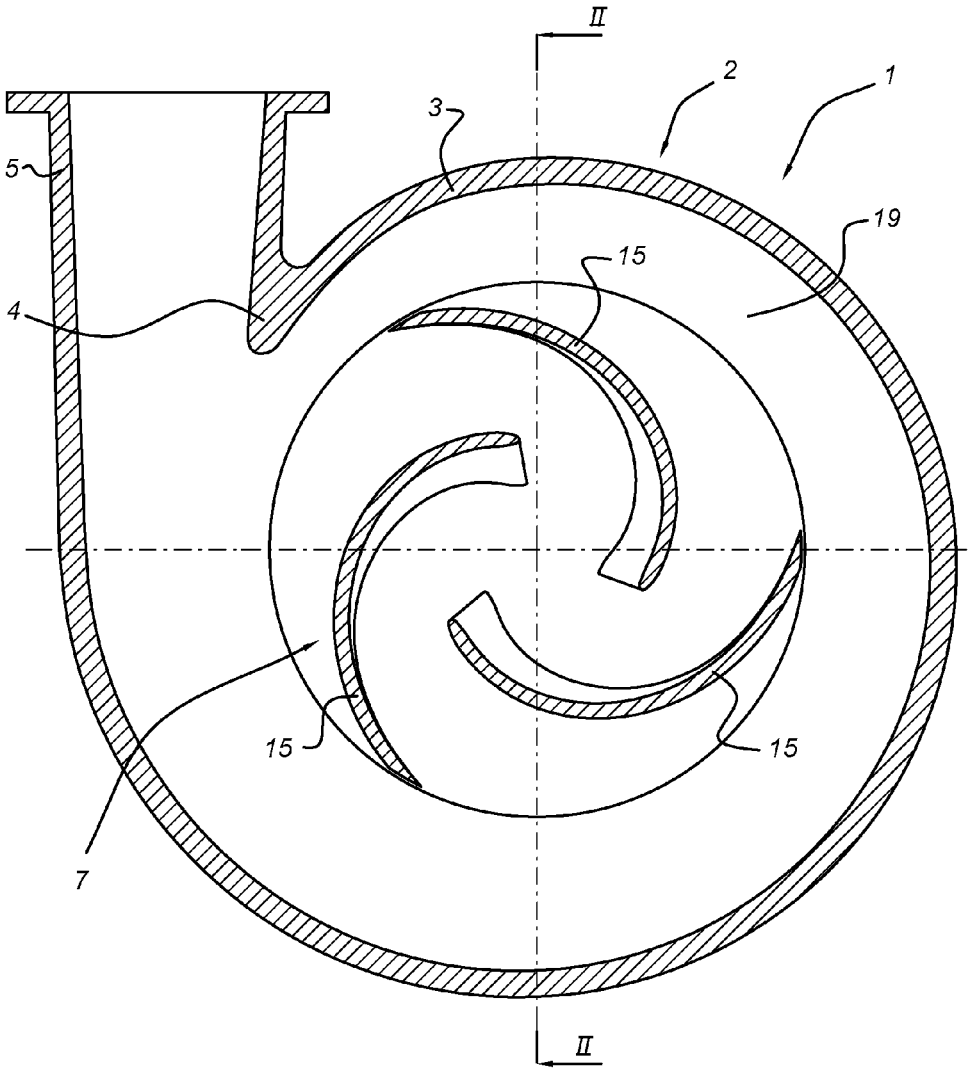
FIGS. 1 and 2 schematically show two different cross-sectional views of a pump according to the prior art, FIG. 3 schematically shows a perspective view of a pump housing according to an embodiment, FIG. 4 schematically depicts a side view of a pump housing according to an embodiment, FIG. 5 schematically depicts a detail of the pump housing according to an embodiment, and FIGS. 6*a*-6 *b* schematically depict a pump housing according to different embodiments.
Figure 2:
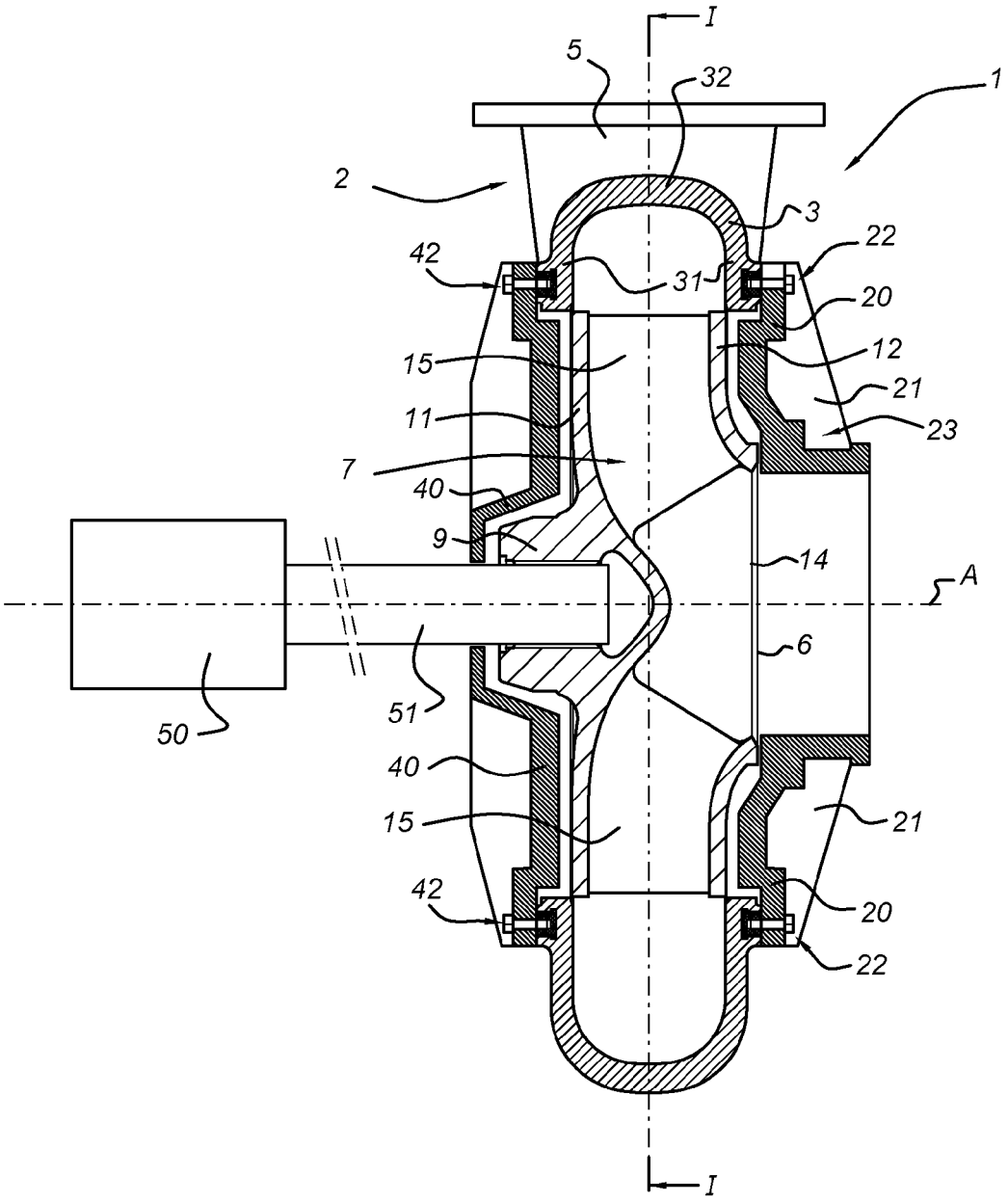

The embodiments will now be described with reference to the figures. FIGS. 1 and 2 show a pump according to the prior art and were discussed above.

Figure 3:
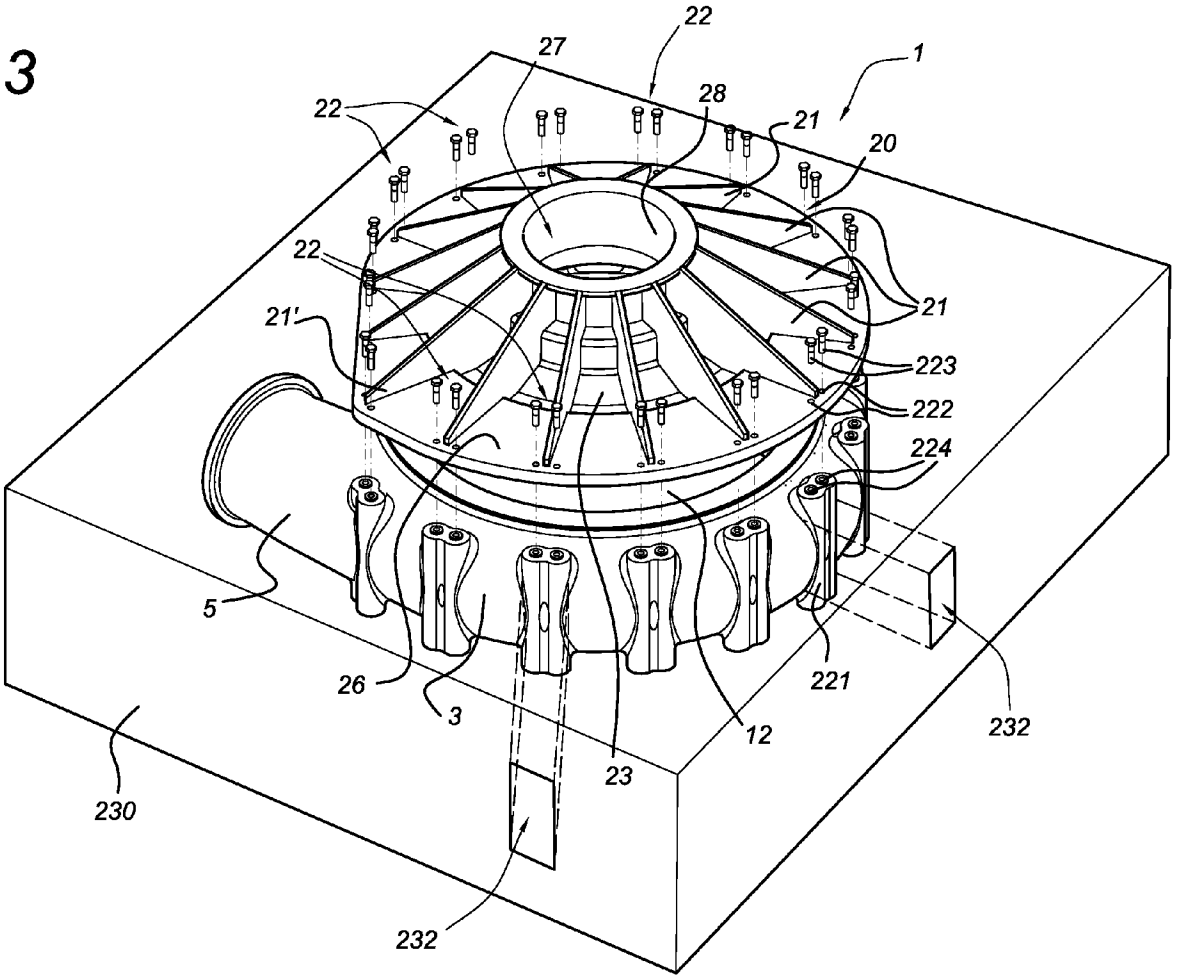

FIG. 3 shows an embodiment of a pump 1, a centrifugal pump, comprising a pump housing 2 with a circumferential wall 3, a pump casing 20 and a shaft cover 40 as described above. The circumferential wall spirals outwardly to form a tangential outlet 5, as shown in the figures.

The pump housing 2 may be suitable for pumping a slurry comprising a mixture of water and dredged materials, such as sand, rocks etc. Therefore, the pump 1 is arranged to accommodate a rotor 7 comprising rotor blades 15, a shaft shield 11 and a suction shield 12 as described above.

The pump casing 20 is formed as a lid arranged to cover the pump housing 2 and provide the pump housing 2 with additional strength. The pump casing 20 has a substantially disc shaped part 26, although the disc shaped part 26 may not have a circular outer circumference, as it may deviate from a circular shape at the position of the outlet 5. In the centre of the pump casing 20 a central opening 27 is provided to allow mass to be pumped to enter the pump housing 2 via the axial inlet 6 and axial supply 14. At the central opening 27 an inlet conduit 28 may be formed as integral part of the pump casing 20, the inlet conduit 28 protruding from the pump casing 20 in the direction of the axial rotation axis A, away from the shaft cover 40 (not shown in FIG. 3). The inlet conduit 28 may form the axial inlet 6.

The pump casing 20 comprises a stepped part 23 forming a transition between the disc shaped part 26 and the inlet conduit 28, making the pump casing 20 strong. Furthermore, a plurality of reinforcing ribs 21 are provided. Each reinforcing rib 21 is substantially perpendicular with respect to the disc shaped part 26 and each reinforcing rib 21 is orientated in a different radial direction.

Also provided is a shaft cover 40 forming the counterpart of the pump casing 20, positioned on the shaft side of the pump housing. The shaft cover 40 also comprises a central opening to allow the drive shaft 51 of motor 50 to pass through and drive the rotor 7 to rotate about axis A.

As shown in FIG. 3, the connection means 22 (connecting the pump casing 20 to the circumferential wall 3) are provided in groups, such as pairs, positioned regularly, i.e. at regular intervals. This will be explained in more detail below with reference to FIG. 6.

The connection means 22 are also positioned adjacent the reinforcing ribs 21. The term adjacent is used here to indicate that that the connection means 22 are positioned close to a reinforcing rib 21, for instance at least 5 times, preferably at least 10 times closer to the closest reinforcing rib 21 than to the second closest reinforcing rib 21.

The connection means 22 may also be positioned close to the outer circumference of the pump casing 20, such that the connection means 22 engage the circumferential wall 3 at the position of the radial outer wall 32. In this case, the term 'close to' is used to indicate that the distance between the connection means 22 and the outer circumference of the pump casing 20 is less than 25%, or preferably less than 10%, of the radius of the pump casing 20, measured from the centre of the central opening 27 to the outer circumference of the disc shaped part 26.

According to the embodiment shown in FIG. 3, the connection means 22 are provided in pairs, i.e. each reinforcing rib 21 has two associated, adjacent, connection means 20, which are provided symmetrically on both sides of the reinforcing rib 21. Of course, more than two connection means 22 may be provided in association with one reinforcing rib 21. In general, a group of connection means 22 may be provided in association with a reinforcing rib 21.

In FIG. 3, connection means 22 are provided for each reinforcing rib 21. However, according an embodiment, some reinforcing ribs 21 may be without associated connection means 22, for instance the reinforcing ribs 21' near the outlet 5.

The connection means 22 may be any suitable connection means 22, such as clamping devices clamping the pump casing against the circumferential wall 3 or clamping the pump casing 20 and the shaft cover 40 together squeezing them against the circumferential wall 3.

Figure 5:
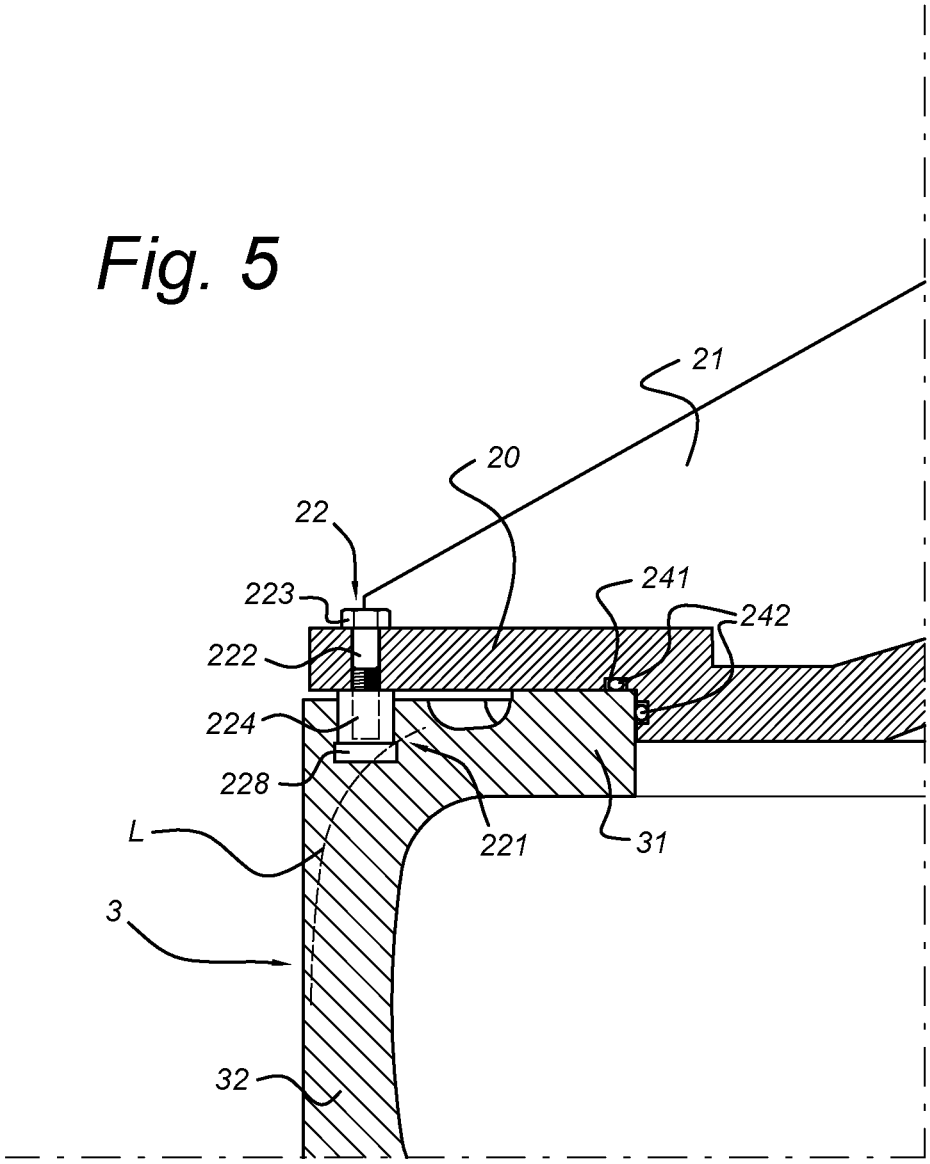

As shown in the Figures, the connection means 22 may be formed by a connection member 223, such as a bolt, and a corresponding bolt receiving hole 224 provided on the circumferential wall 3 and a bolt receiving hole 222 provided on the pump casing 20. This is shown in more detail in FIG. 5, showing part of the circumferential wall 3 and the pump casing 20.

The circumferential wall 3 may be provided with bolt receiving members or bolt receiving structures 221 provided on the outer circumference of the circumferential wall 3, protruding from the spiral outer shape of the outer wall 32 of the circumferential wall 3, and comprising bolt receiving holes 21. The dashed line L shown in FIG. 5 shows the contour of the circumferential wall 3 as it would be without the bolt receiving structure 221, clearly showing that the bolt receiving structure 221 protrudes from the outer wall of the circumferential wall 3.

One bolt receiving structure or structure 221 may comprise one or two bolt receiving holes 21.

The bolt receiving holes 222, 224 are parallel to the axial rotation axis A of the pump, i.e. parallel to the direction in which the internal pressure of the pump 1 will try to move the pump casing 20.

FIG. 5 further shows that the pump casing 20 may comprise annular slots 241 in which sealing members 242, such as O-rings, may be positioned to provide a fluid-tight connection between the circumferential wall 3 and the pump casing 20.

The circumferential wall 3 may be provided with soft inserts 228 which are suitable for forming a threaded bolt receiving hole 224 therein.

Figure 4:
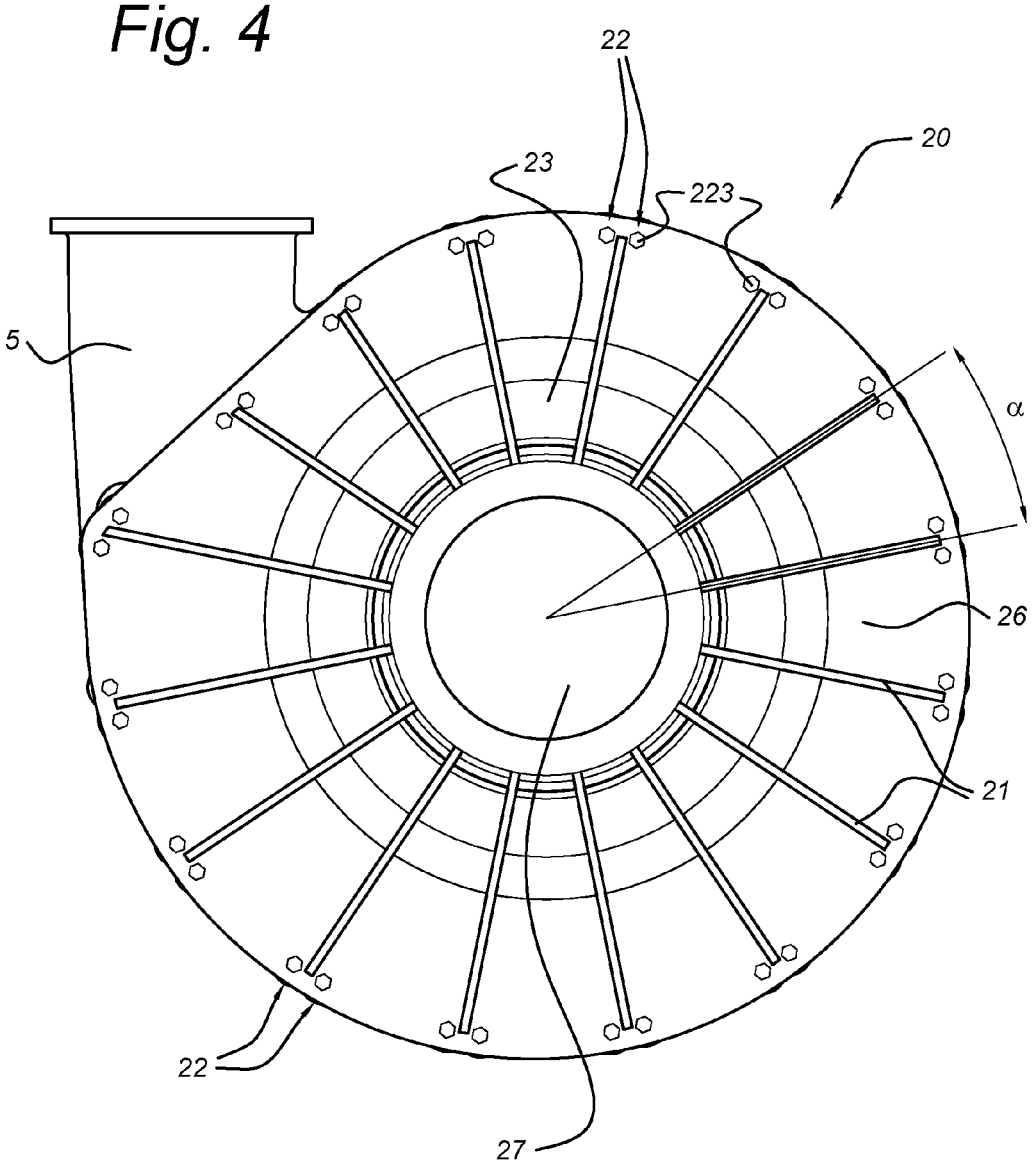

FIG. 4 shows a side view of the pump 1 in the direction of the axial supply 14. It can be seen that the reinforcing ribs 21 are all orientated in a different radial direction at regular mutual angles α. The reinforcing rib 21 or reinforcing ribs 21 close to the outlet 5 may be a bit longer or shorter in radial direction to follow the irregularity of the outer circumference of the pump casing 20 and the circumferential wall 3.

Figure 6A:
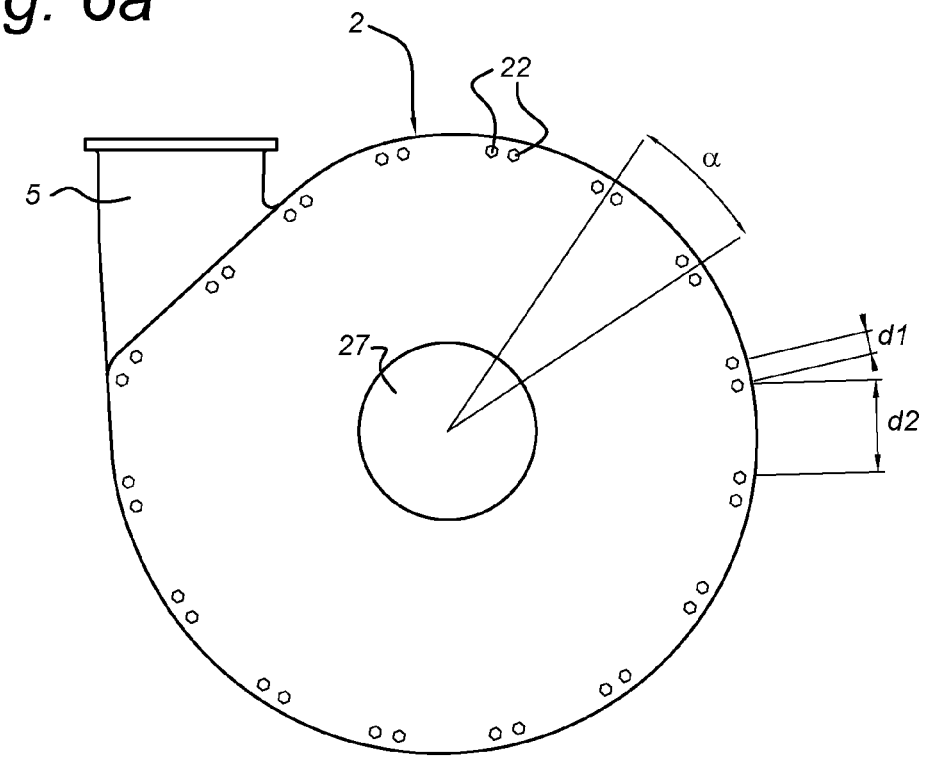
Figure 6B:
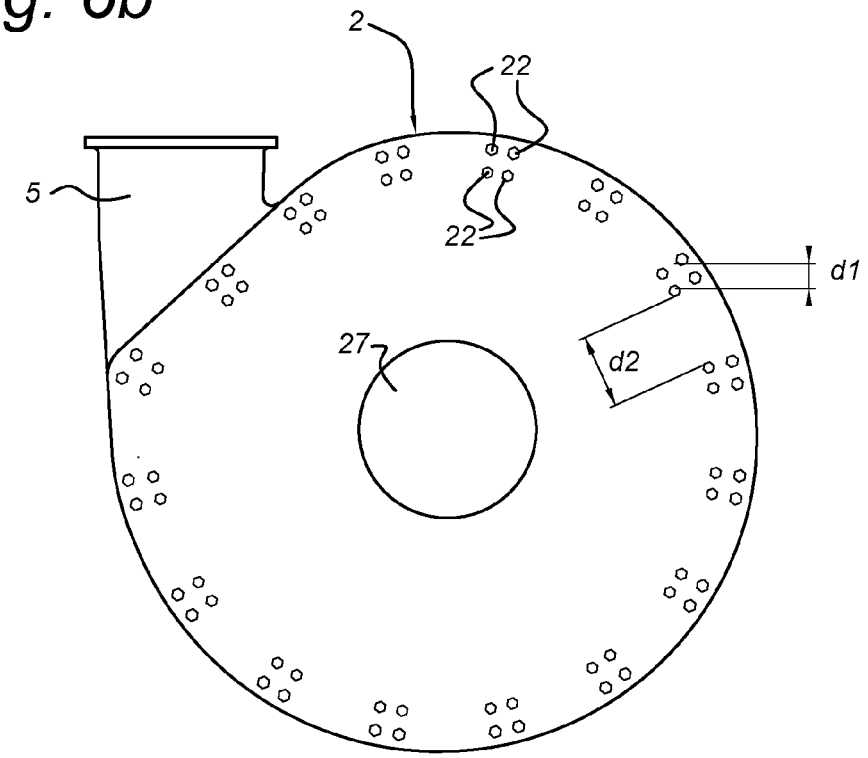

The distribution of the connection means 22 will now be explained in more detail with reference to FIG. 6*a-b*, showing a view of the pump housing 20 in the direction of the rotation axis A.

As shown, the connection means 22 may be positioned in groups, such as pairs (FIG. 6*a*) or in larger groups, for instance comprising four connection means 22, as shown in FIG. 6*b*. The groups are positioned along the circumference of the pump housing 2 and are regularly distributed along the circumference of the pump housing 2. A group may be defined as a number of connection means 22 that are relatively close to each other compared to other connection means 22 which thus do not belong to that group. A group may be defined as a plurality of connection means 22 whereby a largest distance between any two connection means of the group (d1 in FIG. 6*b*) is at least ½ the distance between each connection means of that group to the next closest connection means of a different group (d2 in FIG. 6*b*). This ratio may preferably be ⅓ or even ⅕. This definition also applies to a group of two connection means 22. FIG. 6*a* also shows distances d1 and d2, whereby d1<½d2, preferably d1<⅓ d2 or d1<⅕ d2.

The term regularly distributed is used to indicate that the groups are distributed along the circumference of the pump housing 2 at substantially constant angles α as shown in FIGS. 6*a*-*b* when seen from a centre point of the pump housing 2. In FIGS. 6*a*-6 *b* there are sixteen groups at a mutual angle α=(360/16)°. The term substantially constant is used to indicate that the different angles deviate less than 5°, preferably less than 2° with respect to each other.

Alternatively, the term regularly distributed may be used to indicate that the groups are distributed along the circumference of the pump housing 2 at substantially constant intervals. The term constant is used to indicate that these distances do not deviate more than 15%, preferably less than 10%.

According to an embodiment, the groups are regularly distributed along a substantial part of the circumference of the pump housing 2, whereby the substantial part of the circumference of the pump housing 2 forms at least 75% of the total circumference, so is at least 270°.

Manufacturing a pump 1 or a pump housing 2 as described above may involve casting one or more of the pump parts, such as the circumferential wall 3.

The bolt receiving structures 221 or bolt receiving structures provided on the outer circumference of the circumferential wall 3, protruding from the outer wall of the circumferential wall 3 allow for an advantageous casting process.

The casting mould 230 is provided with casting openings 232 to supply casting material into the mould 230 (see FIG. 3). The bolt receiving structures 221 can be aligned with the casting openings 232 of the mould 230 providing an excellent structure for supplying the casting material into the casting mould. This saves material and thus cost with respect to supplying casting material at other positions.

Also, the bolt receiving structures 221 can advantageously function as risers. During the casting process, the casing material inside the mould will solidify and thus shrink. Risers can function as a buffer reservoir for casting material. Once the material inside the mould has shrunk, the space in between the mould and the shrunk casting material will be filled with casting material from the risers. The risers may not be too small, as this will cause the casting material to cool down relatively quickly compared to the cooling of the rest of the casting material in the mould.

Shaft Cover

It is noted that all the configurations and embodiments of the connection means as described above may also be applied to the connection means 42 connecting the shaft cover 40 to the circumferential wall 3. These connection means 42 may also be positioned in groups along the circumference of the pump housing 2, wherein the groups are regularly distributed along the circumference of the pump housing 2. The shaft cover 40 may comprise a plurality of reinforcing ribs positioned radially with respect to a central opening for the drive shaft, wherein the connection means 42 are positioned adjacent the reinforcing ribs. The connection means 42 of a group may be positioned on opposite sides of the adjacent reinforcing rib. The connection means may be positioned along the outer circumference of the pump 1 and connect the shaft cover 40 to a radial outer wall 32 of the circumferential wall 3. The connection means 42 may be formed by a connection member, such as a bolt, and bolt receiving holes provided on the circumferential wall 3 and bolt receiving holes provided on the shaft cover 40. The circumferential wall 3 may comprise bolt receiving structures provided on the outer circumference of the circumferential wall. Each bolt receiving structure may comprise two bolt receiving holes.

Advantages

The embodiments described provide a pump, which is relatively strong and stiff. The pump can be casted in an efficient way, still resulting in a pump which is strong and stiff.

The descriptions above are intended to be illustrative, not limiting. It will be apparent to the person skilled in the art that alternative and equivalent embodiments of the invention can be conceived and reduced to practice, without departing from the scope of the claims set out below.

The invention claimed is:

1. A pump housing comprising a circumferential wall, a pump casing and a shaft cover, wherein the pump casing is attached to the circumferential wall and wherein the pump casing comprises a central opening to form an axial supply of the pump housing for material to be pumped, the circumferential wall being an outer wall of the pump housing, wherein the pump housing comprises connection means connecting the pump casing to the circumferential wall, wherein the connection means are positioned in groups along the circumference of the pump housing, each group comprising a plurality of connection means, wherein the groups are distributed along the circumference of the pump housing, wherein the connection means are formed by bolts, and bolt receiving holes provided on the circumferential wall and bolt receiving holes provided on the pump casing, wherein the circumferential wall comprises bolt receiving structures provided on the outer circumference of the circumferential wall, wherein the bolt receiving structures protrude in a radially outward direction, wherein each bolt receiving structure comprises at least two bolt receiving holes, wherein the pump casing comprises a plurality of reinforcing ribs positioned radially with respect to the central opening, wherein the connection means are positioned adjacent reinforcing ribs, and wherein the connection means of each group are positioned on opposite sides of the adjacent reinforcing rib.

2. The pump housing according to claim 1, wherein the connection means are positioned along the outer circumference of the pump housing and connect the pump casing to a radial outer wall of the circumferential wall.

3. A pump comprising a pump housing according to claim 1.

4. A method of manufacturing a circumferential wall for a pump housing, wherein the circumferential wall comprises bolt receiving holes provided on the outside of the circumferential wall, the method comprising:

providing a mould for the circumferential wall, the mould comprising a plurality of casting openings, filling the mould with a liquid casting material by supplying the casting material to the mould via the casting openings, allowing the casting material to solidify in the mould, and removing the mould, wherein the bolt receiving holes are positioned in groups along the circumference of the circumferential wall, wherein the groups are regularly distributed along the circumference of the circumferential wall, wherein the circumferential wall comprises bolt receiving structures provided on the outer circumference of the circumferential wall, wherein the bolt receiving structures protrude in a radially outward direction, wherein each bolt receiving structure comprises at least two bolt receiving holes, and wherein the bolt receiving structures align with the casting openings and/or function as risers during casting.

5. The method according to claim 4, wherein the casting material is one of steel, cast steel, grey or white cast iron.

* * * * *